US007290381B2

(12) United States Patent
Smith, III et al.

(10) Patent No.: US 7,290,381 B2
(45) **Date of Patent: *Nov. 6, 2007**

(54) DURABLE, COMFORTABLE, AIR-PERMEABLE ALLERGEN-BARRIER FABRICS

(75) Inventors: John Martin Smith, III, Greensboro, NC (US); Charles Woody Duckett, Kernersville, NC (US)

(73) Assignee: Precision Fabrics Group Inc., Greensboro, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/840,662

(22) Filed: May 7, 2004

(65) Prior Publication Data

US 2005/0032446 A1 Feb. 10, 2005

Related U.S. Application Data

(60) Continuation of application No. 09/878,416, filed on Jun. 12, 2001, now abandoned, which is a division of application No. 09/667,614, filed on Sep. 22, 2000, now Pat. No. 6,277,770, which is a continuation-in-part of application No. 09/165,287, filed on Oct. 2, 1998, now abandoned.

(60) Provisional application No. 60/061,431, filed on Oct. 8, 1997.

(51) Int. Cl.
*D03D 15/00* (2006.01)
*A47G 9/00* (2006.01)

(52) U.S. Cl. ..... 53/396; 5/737; 5/490; 5/491; 5/501; 442/190; 442/191; 442/197; 442/123; 428/315.5; 428/315.7

(58) Field of Classification Search ..... 442/197, 442/190, 191, 123; 53/396; 5/737, 490, 5/491, 501; 428/315.5, 315.7
See application file for complete search history.

(56) References Cited

U.S. PATENT DOCUMENTS

| | | | |
|---|---|---|---|
| 4,416,787 | A | 11/1983 | Marshall et al. |
| 4,515,761 | A | 5/1985 | Plotzker |
| 4,582,747 | A | 4/1986 | Hirakawa et al. |
| 4,822,667 | A | 4/1989 | Goad et al. |
| 4,967,456 | A | 11/1990 | Sternlieb et al. |
| 4,995,151 | A | 2/1991 | Siegel et al. |
| 5,024,851 | A | 6/1991 | Goad et al. |
| 5,050,256 | A | 9/1991 | Woodcock |
| 5,271,947 | A | 12/1993 | Miller et al. |
| 5,321,861 | A | 6/1994 | Dancey et al. |
| 5,368,920 | A | 11/1994 | Schortmann |
| 5,409,761 | A | 4/1995 | Langley |
| 5,424,117 | A | 6/1995 | Heiman et al. |
| 5,626,950 | A | 5/1997 | Shimano et al. |
| 5,632,072 | A | 5/1997 | Simon et al. |
| 5,856,245 | A | 1/1999 | Caldwell et al. |
| 5,939,340 | A | 8/1999 | Gabbay |
| 5,966,759 | A | 10/1999 | Sanders et al. |
| 6,017,601 | A | 1/2000 | Amsel |
| 6,040,251 | A | 3/2000 | Caldwell |
| 6,277,770 | B1 | 8/2001 | Smith, III et al. |

FOREIGN PATENT DOCUMENTS

| | | |
|---|---|---|
| CH | 667196 | 9/1988 |
| DE | 29619026 U1 * | 3/1997 |
| EP | 600459 | 6/1994 |
| EP | 0 779 385 B1 | 12/1996 |
| EP | 0 908 122 A2 | 4/1999 |
| GB | 695703 | 8/1953 |
| WO | 96/21379 | 7/1996 |

OTHER PUBLICATIONS

Results from Google™ search on "pristine PFG" (2 pages).
Documents form PFG Internet Home page related to Pristine® Allergen Barrier Fabrics (4 pages).
"Milben murbe machen," *Test*, Issue No. 3/2003, pp. 68-71.
Partial translation of "Milben murbe machen," *Test*, Issue No. 3/2003, pp. 68-71, as submitted in European Opposition.

* cited by examiner

*Primary Examiner*—Elizabeth M. Cole
(74) *Attorney, Agent, or Firm*—Smith Moore LLP

(57) ABSTRACT

An allergen-barrier fabric includes a tightly-constructed fabric substrate, woven from 0 to 45% continuous synthetic filament yarns and 55 to 100% natural or synthetic spun yarns. The fabric substrate is finished to produce a fabric with a mean pore size of 4 to 10 microns, an air permeability of 0.5-25 cfm, a mean fabric flexibility of 0.5 to 6.5 grams (bending resistance), and a moisture vapor permeability in excess of 800 g/m$^2$/24 hours. This fabric provides a barrier to mite-induced allergen particles. Various additional finishes can be included on the fabric. For example, an antimicrobial finish may be provided on the fabric to extend fabric wearlife by providing protection against mold and mildew. As another alternative, a fluorochemical finish can be provided to extend fabric wearlife by providing protection against fluid stains.

18 Claims, No Drawings

DURABLE, COMFORTABLE, AIR-PERMEABLE ALLERGEN-BARRIER FABRICS

This application is a continuation of application Ser. No. 09/878,416, filed Jun. 12, 2001, now abandoned, which is a divisional of application Ser. No. 09/667,614 filed Sep. 22, 2000, now U.S. Pat. No. 6,277,770, which is a continuation-in-part of 09/165,287, filed Oct. 2, 1998, now abandoned, which claims the benefit of provisional application Ser. No. 60/061,431, filed Oct. 8, 1997.

FIELD OF THE INVENTION

This invention relates to allergen-barrier fabrics that are durable, air-permeable, and comfortable. The fabrics according to this invention have improved softness and feel while still providing an allergen barrier that substantially impedes and/or stops passage of dust, dust mites, and other allergens through the fabric.

BACKGROUND OF THE INVENTION

A major source of indoor allergy-causing proteins are dust mites. Dust mites, 100 to 300 microns in size, cannot be seen with the naked eye. Dust mite excrement, which is a key component that causes allergic reactions, is even smaller, ranging in size down to 10 microns. Thus, in order to be an effective barrier to dust, dust mites, and their allergy-causing particles, a fabric or material must limit the transmission of 10 micron particles through its planar surface. These facts are discussed, for example, in Platts-Mills TAE, et al., "Dust Mite Allergens and Asthma: Report of a Second International Workshop," J. Allergy Clin. Immunology, 1992, Vol. 89, pp. 1046-1060 ("Several studies have demonstrated that the bulk of airborne group I mite allergen is associated with the relatively 'large' fecal particle, 10 to 40 Vm in diameter."); AllerGuard Pte Ltd. Website, 1996 ("The house dust mite cannot be seen with the naked eye, as it only measures 0.1 to 0.5 mm" [which corresponds to 100 to 500 microns]); and U.S. Pat. No. 5,050,256 to Woodcock, et al., (e.g., column 1, lines 44-46—"Ideally, if the mite barrier has pores, it should have a pore size generally less than 10 microns. It is apparent that anything smaller causes no allergic reaction."). The Platts-Mills and Woodcock documents each are entirely incorporated herein by reference.

The major concentration of dust mites in the home is found in the bedroom. For example, an average mattress can support a colony of 2 million dust mites. Pillows also are an excellent habitat for dust mites. Six-year old pillows typically have 25% of their weight made up of dust, dust mites, and allergen. Sofa cushions, chair cushions, carpets, and other foam or fiber filled articles also provide a suitable habitat for dust mites. In effect, every home contains many areas where dust mites can thrive.

Additionally, the presence of allergens from dust mites is a problem that increases as pillows, mattresses, and the like become older. During its lifetime, a typical dust mite produces up to 200 times its net body weight in excrement. This excrement contains the allergen that triggers asthma attacks and allergic reactions, including congestion, red eyes, sneezing, and headaches. The problem is exacerbated by the fact that it is difficult to remove dust mites from the materials in which they thrive. Pillows are rarely laundered, while most mattresses are never washed.

Commercially-available allergy-relief bedding products offer a wide array of claims regarding their efficacy as allergen barriers. These products are assumed to function as allergen barriers because they form an impervious film (as with the laminates) or because they are "tightly woven" (as with 300-count cotton sheeting) or because they have a pore size that is too small to permit allergen penetration (as with nonwovens).

Each of the above-noted products, however, has its own associated disadvantages. Laminated or coated materials typically are uncomfortable (due to little or no moisture vapor permeability), stiff, not soft to the touch, and noisy (i.e., make relatively loud, rustling noises when a person moves on the sheet or pillow). Additionally, while vinyl, polyurethane, and microporous coated fabrics are considered excellent barriers to allergens, they require venting when used as pillow or mattress tickings since air flow is not possible through these materials. U.S. Pat. No. 5,050,256 describes such a product. Pillows or mattresses covered with these materials cannot deflate and re-inflate when compressed, unless they are vented. The need to vent these fabrics, however, begs the question of whether they can be considered effective allergen barriers (as allergens can also enter and escape through the vents). Coated and laminated fabrics also tend to have a limited wearlife due to coating delamination.

Uncoated cotton sheetings, although promoted as such, are not true barriers to allergens due to their inherently large pore sizes. Allergy specialists routinely urge patients to launder their bedding products on a weekly basis. Such practices, however, only serve to further enlarge the pore size of cotton sheetings as fiber is lost with extended laundering.

Spunbond/meltblown/spunbond (SMS) polyolefin nonwovens used in mattress and pillow covers do provide a degree of barrier protection to allergens. SMS nonwovens also exhibit excellent air porosity. Their wearlife, however, is very short, particularly with hot laundering temperatures normally used by allergy sufferers. SMS nonwoven fabrics also have a significantly stiffer and harsher hand as compared with standard pillow tickings.

Other barrier products are known from the literature and are available on the market. For example, U.S. Pat. No. 4,822,667 issued to Goad et al. describes a reusable, launderable, sterilizable medical barrier fabric woven from 100% polyester fiber constructed of polyester yarn. This fabric is said to be blood and aqueous fluid transmission resistant, abrasion resistant, flame resistant, lint free, drapable, and sufficiently porous to eliminate heat build-up. The described material is used in medical garments, wraps, and sterilizable articles. This patent does not describe the use of the fabric as an allergen barrier. The Goad patent is entirely incorporated herein by reference.

U.S. Pat. No. 5,050,256 issued to Woodcock describes an allergen proof bedding system with a cover permeable to water vapor. As noted above, this patent is entirely incorporated herein by reference. The cover material described in this patent is made of Baxenden Witcoflex 971/973 type polyurethane-coated woven polyester or nylon fabric. This fabric is not air permeable; however, it does have a moisture vapor transmission ("MVT") rate of 2,500 to 7,000 g of water/$m^2$/day. Typically, the coated side of the fabric is on the inside of the sewn cover, and the seams are sealed. This product, however, has the disadvantages of coated or laminated materials described above.

U.S. Pat. No. 5,368,920 issued to Schortmann (International Paper Co.) describes a nonporous, breathable barrier fabric and related methods of manufacture. The fabric is a breathable barrier fabric created by filling void spaces in a fabric substrate with film-forming clay-latex material having a density range of 1,000 to 2,000 gm/l, to provide a barrier fabric permeable to water vapor and impermeable to liquids and air. The MVT rate ranges from 300 to 3,000 g/$m^2$/day. Applications include industrial, hospital, and other protective coverings. Again, this product has the disadvantages associated with coated and laminated fabrics, as described above.

Dancey, in U.S. Pat. No. 5,321,861, describes a protective cover for upholstered or padded articles, such as bedding, made from a microporous ultrafilter material having a pore size of less than 0.0005 mm. This material suppresses passage of fecal particles produced by house dust mites. To prevent particles from bypassing the ultrafilter material, the seams of the cover are welded, and its opening is sealed by a resealable fastener, such as a zip-fastener, covered with an adhesive tape.

SUMMARY OF THE INVENTION

It is an object of this invention to overcome the various disadvantages of the known allergen and barrier fabric materials and to provide a fabric that is soft and comfortable, but still provides an effective barrier against transmission of dust, dust mites, their excrement, and other allergens.

According to this invention, an allergen-barrier fabric includes a tightly-constructed fabric substrate, woven from continuous natural and/or synthetic filament and/or spun yarns. The fabric substrate is finished so as to provide a fabric with a mean pore size of 4 to 10 microns, an air permeability of 0.5-25 cubic feet per minute per square foot of fabric at 0.5 inches of water ("cfm," measured by Federal Test Method Standard (FTM) 5450, also known as ASTM D-737), a mean fabric flexibility of 0.5 to 6.5 grams (bending resistance), and a moisture vapor permeability in excess of 800 g/$m^2$/24 hours. These specifications relate to the finished fabric, prior to regular use and laundering. With these specifications, the resultant fabric is soft and comfortable while still providing a barrier to mite-induced allergen particles.

In a preferred embodiment of the invention, the allergen-barrier fabric has a maximum initial pore size of 10 microns.

Various fabric finishes can be included on the allergen-barrier fabric of the invention. For example, the allergen-barrier fabric can include an antimicrobial finish to extend fabric wearlife by providing protection against mold and mildew. As another example, the allergen-barrier fabric of the invention also can include a fluorochemical finish to extend fabric wearlife by providing protection against fluid stains. These additional finishes can be used individually, in combination, or together with other possible finishes.

This invention further relates to a method for providing an allergen-barrier for a pillow or mattress by covering the pillow or mattress with a tightly-constructed, non-coated, non-laminated fabric. The fabric, as noted above, is woven from continuous natural and/or synthetic filament and/or yarns and finished to a fabric with a mean pore size of 4 to 10 microns, an air permeability of 0.5-25 cfm, a mean fabric flexibility of 0.5 to 6.5 grams (bending resistance), and a moisture vapor permeability in excess of 800 g/$m^2$/24 hours. This fabric provides a barrier to mite-induced allergen particles.

In this invention, the allergen-barrier cover material can take on any suitable form. For example, it can be a pillow ticking, a pillow cover, a mattress ticking, a mattress cover, a mattress pad, a duvet cover, or a bedspread. Furthermore, while it is preferred that the allergen-barrier fabric according to the invention cover all surfaces of the pillow or mattresses so as to completely encase the pillow or mattress, this is not a requirement in all embodiments. For example, typical mattress pads do not completely encase a mattress.

DETAILED DESCRIPTION OF THE INVENTION

This invention relates to an allergen-barrier fabric that possesses a unique combination of properties to provide an allergen-barrier material that is superior to other commercially available products. The fabric according to the invention has a unique combination of air porosity (to allow venting through the fabric's planar surface), moisture vapor transport (to enhance a user's comfort), fabric flexibility (also a comfort-enhancing property), extremely small pore size (to filter out allergens), and durability to laundering (as required of allergy-relief products) to provide that superior product. This combination of properties is provided by weaving fine-denier synthetic filament yarns into a tight plain-weave construction with post finishing processes that maximize fiber coverage and filtration efficiency. In effect, the fabrics according to the invention provide the barrier performance of coated or laminated fabrics, while exhibiting the flexibility, air porosity, and moisture-vapor porosity needed to enhance comfort and "refluffability" of fiber-filled products, and while also offering a durability not possible with nonwoven or coated/laminated fabrics.

The fabric material according to the invention can be used for any suitable in purpose, but it is preferably used as a fabric for covering items that typically are susceptible to dust mite infestation. As noted above, pillows and mattresses provide a very favorable environment for sustaining dust mite colonies. Therefore, advantageously, the fabric according to the invention can be used for pillow tickings, pillow covers, mattress pads, mattress tickings, mattress covers, duvet covers, and/or bedspreads. When used in such articles, the fabric provides a barrier to prevent dust mites from entering, a pillow or mattress. Additionally, the fabric, when used in such articles, can prevent dust mites and allergens already existing in mattresses and pillows from exiting the mattress or pillow e.g., when the article is compressed during use.

As used in this patent application, the following definitions apply:

A "pillow ticking" means a pillow's non-removable fabric covering that encases the fiberfill or other padding.

A "pillow cover" means a pillow's removable fabric cover that also can function as a decorative, washable encasement (e.g., a pillow case). For allergy sufferers, a pillow cover also can function as an allergen barrier. Pillow-cover closures are usually either zippers or overlapping flaps.

A "mattress pad" is a quilted removable covering for a mattress. For allergy sufferers, the innermost or the outermost fabric in the pad can function as an allergen barrier.

A "mattress ticking" means a mattress's non-removable fabric covering that encases the fiberfill or other padding and springs.

A "mattress cover" is a mattress's removable fabric cover that also can function as a decorative, washable encasement.

Institutional mattress covers also must provide a barrier to fluids. For allergy sufferers, such a cover also can function as an allergen barrier. Mattress-cover closures typically are either zippers or overlapping flaps.

Given the above background information, the invention will now be described in more detail. This invention embodies a textile system that can advantageously be used as an integral component in pillow covers, pillow cases, pillow tickings, mattress cases, mattress pads, mattress tickings, mattress covers, duvet covers, and bedspreads for the purpose of creating a barrier to mite-induced allergen particles. The invention is not limited, however, to these enumerated products. For example, the fabric according to the invention could be used in many other products, such as sheets, sleeping bags, down-filled bedding, upholstered furniture, stuffed toys, and similar fiber-filled or padded items.

The textile system according to the invention is comprised of natural and/or synthetic spun and/or filament yarns of polyester and/or nylon and/or cotton, closely woven, and subsequently scoured, heat-treated, or otherwise finished to further constrict the fabric's pore size. The textile fabric's construction and chemical treatments are controlled to impart a unique combination of:

(1) air permeability (to provide compressibility necessary when used in covers for fiber-filled bedding products);
(2) moisture vapor permeability (to enhance sleeping comfort);
(3) fabric flexibility (also to enhance comfort);
(4) laundering durability (to provide relatively long term allergen-barrier protection after several wash cycles as typically required for allergy-relief textile articles); and
(5) filtration efficiency (the paramount feature necessary to function as a barrier to allergens).

The fabric according to this invention provides an excellent combination of these five textile properties to produce a barrier fabric that is superior to other commercially-available materials.

Preferred embodiments of this invention include a fabric substrate made from 55-65% spun polyester and 35-45% filament polyester, 55-65% spun cotton and 35-45% filament polyester, and 100% spun cotton all by weight, densely woven in a plain weave, with warp and filling yarns totaling 215 yarns per square inch. The preferred fabric finishing process includes scouring, heat setting, width/length fabric shrinkage, and mechanical manipulation to further compact the yarn-to-yarn spacing. The resulting fabric product has a mean pore size of 4 to 10 microns, an air permeability of 0.5-25 cfm (advantageously, 0.5 to 15 cfm), a mean fabric flexibility of 0.5 to 6.5 grams (bending resistance), and a moisture vapor permeability in excess of 800 $g/m^2/24$ hours (advantageously 1100 to 2400 $g/m^2/24$ hours or 1200 to 2400 $g/m^2/24$ hours). Mechanical manipulation can involve calendaring, wherein yarns are flattened via heat and pressure to further close fabric pores; dimensional shrinkage, wherein fabrics are bulked and agitated in conventional pressure jet equipment in such a way as to cause width and/or length shrinkage of the fabric to its minimum yarn spacing, or high-speed impingement and agitation via water or dye liquor, wherein fibers are flattened and dispersed in a highly uniform manner. No further coatings or film laminations are required.

As mentioned above, during production of the fabric according to the invention, high pressure water or dye liquor can be sprayed onto the surface of the fabric. This process tends to matt out the fabric fibers, thereby reducing the spaces between fibers and the fabric pore size and also improving the fabric softness and hand. This high pressure liquid impingement process also can be used to texturize or pattern the fabric, if desired. Suitable devices and systems for performing this high pressure liquid impingement are described, for example, in U.S. Pat. Nos. 4,967,456; 4,995,151; and 5,632,072, each of which is entirely incorporated herein by reference.

Chemical enhancements to the preferred embodiment of the fabric according to the invention include the application of a permanent antimicrobial finish and a flexible fluorochemical finish. In this context, "permanent" denotes efficacy of the respective finishes for the lifetime of the product. Any suitable antimicrobial or fluorochemical finish can be used without departing from this invention, and such finishes are known in the art (see, for example, U.S. Pat. No. 4,822,667, supra.). As an example of a suitable antimicrobial finish, a very durable compound of 3-(trimethoxysilyl)-propyidimethyloctadecyl ammonium chloride (Dow Coming 5700) can be applied. This finish protects the fabric against bacteria and fungi, and inhibits the growth of odor-causing bacteria. It has been shown to be effective against bacteria (*Streptococcus faecalis, K. pneumoniae*), fungus (*Aspergillus niger*), yeast (*Saccharomyces cerevisiae*), wound isolates (*Citrobacter diversus, Staphylococcus aureus, Proteus mirabilis*), and urine isolates (*Pseudomonas aeruginosa, E. coli*). The fluorochemical finish can be a permanent micro-thin flexible fluorochemical film that imparts fluid repellency (see, for example, those described in U.S. Pat. No. 4,822,667, supra.). Unlike fabrics used in medical barrier applications, however, the allergy barrier fabric according to the present invention is generally not concerned with fluid repellency properties, as exemplified by a substantially negligible Suter rating. A Suter rating is an indication of a fabric's resistance to water penetration, as measured by a hydrostatic pressure test, specifically, the hydrostatic head required for three drops of water to penetrate a fabric. The lower the Suter rating, the lower the fabric's resistance to water penetration, i.e., the lower the hydrostatic head required for three drops of water to penetrate a fabric. In the case of the claimed fabric, the Suter rating is below 20.

The use of polyester and/or nylon and/or cotton of continuous filament and/or spun yarns in the fabric according to the invention creates a high-strength, flexible substrate that is extremely durable to home and commercial laundering. Subsequent fluorochemical and antimicrobial finishes, as described above, further protect the fabric against degradation due to fluid stains, molds, and mildew. Because the fabrics are tightly woven where yarn-to-yarn abrasion is restricted, there is little chance for fiber breakage and linting. Therefore, fabric pore sizes remain sufficiently and consistently small throughout extended laundering. This is important because if excessive fiber is lost during actual use or through extended launderings, progressively larger pore sizes are created and the allergen-barrier properties of the fabric product would be significantly deteriorated.

Fiber-filled products using the fabrics according to the invention as a covering material can be compressed and then recover without the loss of allergen-barrier properties. Air vents are not required as an integral component of the fabricated product, thus reducing labor and material costs associated with its manufacture. The lack of air vents also eliminates potential entry/exit ports for dust mites and associated allergens.

The flexibility of the fabrics according to the invention has a very positive effect upon the drape, noise, handle, and comfort of the ultimate end-item. The inventive fabrics have a mean fabric flexibility of 0.5 to 6.5 grains (bending resistance). The mean flexibility is the mean of the bending resistance of the fabric in the machine a direction (MD) and the cross machine direction (XD), measured by INDA Test No. IST-90.3 on a Handle-O-Meter Model 211-5. Because the fabrics according to the invention do not involve coatings or laminations, their flexibility and ease of movement is excellent.

The fabrics according to the invention also have a moisture vapor permeability or transmission rate in excess of 800 g/m$^2$/24 hours. In certain embodiments of the invention, the moisture vapor permeability is in the range of 1100 to 2400 g/m$^2$/24 hours, and advantageously between 1200 and 2400 g/m$^2$/24 hours. By maintaining a moisture vapor permeability of at least 800 g/m$^2$/24 hours, comfort levels for the user are enhanced because the passage of evaporating perspiration through the material is not impaired. This feature is a decided advantage over vinyl-coated products.

Furthermore, given that the fabrics according to the invention are not coated or laminated, coating loss or delamination during use or laundering (which leads to barrier performance degradation) is not possible. This is another advantage of the invention over coated or laminated products. The useful life of bedding articles fabricated from the fabrics according to the invention is thereby maximized.

Finally, by maintaining a mean pore size of 4 to 10 microns, the fabrics according to the invention are very effective barriers to dust mites and their allergy-causing excrement. In another embodiment of this invention, the fabric has a maximum pore size of 10 microns. This small maximum pore size provides long term protection against dust, dust mite, and allergen transmission.

Specific examples of fabric products according to the invention follows. As with the more general description above, these examples should be construed as illustrating the invention and not as limiting the same.

EXAMPLES

This invention, as described above, includes a unique and unequaled combination of durability, flexibility, air porosity, moisture vapor transport, and allergen-barrier performance as compared with existing bedding cover fabrics.

Example 1

A suitable fabric according to the invention was manufactured from 70-denier, 34-filament texturized polyester yarns, woven in a plain-weave construction. After weaving, the fabric construction had 129 warp ends per inch and 86 filling yarns per inch, with a fabric weight of 2.28 ounces per yard. Subsequent processes included scouring, calendaring, and treating with durable antimicrobial and fluorochemical finishes. After processing, the fabric construction was 144 warp ends per inch and 89 filling yarns per inch, with a fabric weight of 2.56 ounces per yard.

Comfort and barrier properties for this fabric are given in the Table below:

TABLE 1

| | Original | After Five Launderings |
|---|---|---|
| Pore Size | | |
| Minimum | 2.060μ | 2.731μ |
| Maximum | 9.935μ | 12.85μ |
| Mean | 4.372μ | 5.156μ |
| Moisture Vapor Transmission Rate | 1,207 g/m$^2$/24 hours | 1,265 g/m$^2$/24 hours |
| Flexibility* | 6.1 grams | 3.2 grams |
| Air Permeability | 0.622 cubic feet/minute | 1.130 cubic feet/minute |

*Measured as the mean bending resistance (grams of resistance to bending) of the fabric in the machine direction (MD) and the cross machine direction (XD) using INDA Test No. IST-90.3, Handle-O-Meter Model 211-5.

Example 2

A suitable fabric according to the invention was manufactured from 40/1 Ring Spun Combed Cotton, woven in a plain weave construction. After weaving, the fabric construction had 112 warp ends per inch and 124 filling yarns per inch, with a fabric weight of 4.40 ounces per square yard. Subsequent processes include scouring, relax drying, and calendaring. After processing, the fabric construction was 120 warp ends per inch and 120 filling yarns per inch, with a fabric weight of 4.25 ounces per square yard.

Comfort and barrier properties for this fabric are given in the Table below.

TABLE 2

| | Original | After Five Launderings |
|---|---|---|
| Pore Size | | |
| Minimum | 4.170μ | 3.809μ |
| Maximum | 15.855μ | 16.202μ |
| Mean | 4.558μ | 5.014μ |
| Moisture Vapor Transmission Rate | 806 g/m$^2$/24 hours | 965 g/m$^2$/24 hours |
| Flexibility* | 9.9 grams | 4.1 grams |
| Air Permeability | 3.50 cubic feet/minute | 6.82 cubic feet/minute |

*Measured as the mean bending resistance (grams of resistance to bending) of the fabric in the machine direction (MD) and the cross machine direction (XD) using INDA Test No. IST-90.3, Handle-O-Meter Model 211-5.

Example 3

A suitable fabric according to the invention was manufactured from 70 denier, 34 filament texturized polyester yarn in the warp direction, and 26/1 Air Jet Spun Polyester in the filling direction, woven in a plain weave construction. After weaving, the fabric construction had 144 warp ends per inch and 78 filling yarns per inch, with a fabric weight of 3.73 ounces per square yard. Subsequent processes include scouring, and tenter frame finishing. After processing, the fabric construction was 164 warp ends per inch and 88 filling yarns per inch, with a fabric weight of 4.45 ounces per square yard.

Comfort and barrier properties for this fabric are given in the Table below.

TABLE 3

| | Original | After Five Launderings |
|---|---|---|
| Pore Size | | |
| Minimum | 8.399μ | 8.046μ |
| Maximum | 19.584μ | 19.022μ |
| Mean | 8.934μ | 8.990μ |
| Moisture Vapor Transmission Rate | 950 g/m$^2$/24 hours | 1080 g/m$^2$/24 hours |
| Flexibility* | 5.0 grams | 2.8 grams |
| Air Permeability | 7.8 cubic feet/minute | 7.6 cubic feet/minute |

*Measured as the mean bending resistance (grams of resistance to bending) of the fabric in the machine direction (MD) and the cross machine direction (XD) using INDA Test No. IST-90.3, Handle-O-Meter Model 211-5.

Example 4

A suitable fabric according to the invention was manufactured from 70 denier, 34 filament texturized polyester yarn in the warp direction, and 28/1 open end combed cotton spun yarn in the filling direction, woven in a plain weave construction. After weaving, the fabric construction had 144 warp ends per inch and 78 filling yarns per inch, with a fabric weight of 3.58 ounces per square yard. Subsequent processes include scouring, and tenter frame finishing. After processing, the fabric construction was 164 warp ends per inch and 88 filing yarns per inch, with a fabric weight of 3.80 ounces per square yard.

Comfort and barrier properties for this fabric are given in the Table below.

TABLE 4

| | Original | After Five Launderings |
|---|---|---|
| Pore Size | | |
| Minimum | 6.088μ | 6.002μ |
| Maximum | 18.156μ | 18.640μ |
| Mean | 8.992μ | 9.108μ |
| Moisture Vapor Transmission Rate | 961 $g/m^2/24$ hours | 992 $g/m^2/24$ hours |
| Flexibility* | 6.8 grams | 4.4 grams |
| Air Permeability | 14.5 cubic feet/minute | 5.8 cubic feet/minute |

*Measured as the mean bending resistance (grams of resistance to bending) of the fabric in the machine direction (MD) and the cross machine direction (XD) using INDA Test No. IST-90.3, Handle-O-Meter Model 211-5.

In this application, Applicant has described certain theories and/or mechanisms in an effort to explain how and why this invention works in the manner in which it works. These theories and mechanisms are set forth for informational purposes only. Applicant is not to be bound by any particular chemical, physical, or mechanical theory of operation.

While the invention has been described in terms of various preferred embodiments using specific examples, those skilled in the art will recognize that various changes and modifications can be made without departing from the spirit and scope of the invention, as defined in the appended claims.

We claim:

1. A method for providing an allergen-barrier for an article susceptible to dust mite infestation comprising:

covering the article with a fabric that is woven from 0 to 45% continuous synthetic filament yarns and 55 to 100% spun yarns, said spun yarns comprising both natural fibers and synthetic fibers, finished to produce a fabric with an air permeability of 0.5-25 cfm, a mean fabric flexibility of 0.5 to about 10 grams, and a moisture vapor permeability in excess of 800 $g/m^2/24$ hours, wherein the fabric provides a barrier to mite-induced allergen particles.

2. The method according to claim 1, wherein the article is a mattress or pillow.

3. The method according to claim 2, wherein the fabric is used as a pillow ticking, mattress ticking, mattress cover, mattress pad, bedspread or duvet cover.

4. The method according to claim 1, wherein the fabric has a mean pore size of 4 to 10 microns.

5. The method according to claim 1, wherein the fabric further includes an antimicrobial finish to provide protection against mold and mildew.

6. The method according to claim 1, wherein the fabric further includes a fluorochemical finish to provide protection against fluid stains.

7. A method for providing an allergen-barrier for an article susceptible to dust mite infestation, comprising:

covering the article with a fabric that is woven from 65-100% continuous synthetic filament yarns and finished to produce a fabric with an air permeability of 0.5-25 cfm, a mean fabric flexibility of 0.5 to about 10 grams, and a moisture vapor permeability in excess of 800 $g/m^2/24$ hours and a Suter rating less than 20, wherein the fabric provides a barrier to mite-induced allergen particles.

8. The method according to claim 7, wherein the fabric has a mean pore size of 4 to 10 microns.

9. The method according to claim 7, wherein the fabric further includes an antimicrobial finish to provide protection against mold and mildew.

10. The method according to claim 7, wherein the fabric further includes a fluorochemical finish to provide protection against fluid stains.

11. The method according to claim 7, wherein the fabric is used as a mattress ticking, mattress cover, mattress pad, bedspread, pillow ticking, pillow cover or duvet cover.

12. The method according to claim 7, wherein the article is a mattress or pillow.

13. A method for providing an allergen-barrier for an article susceptible to dust mite infestation comprising:

covering the article with a fabric that is woven from 65-100% continuous synthetic filament yarns and finished to produce a fabric, which exhibits after five launderings, a mean pore size of 4 to 10 microns, an air permeability of 0.5-25 cfm, a mean fabric flexibility of 0.5 to about 10 grams, a moisture vapor permeability in excess of 800 $g/m^2/24$ hours and a Suter rating less than 20, wherein the fabric provides a barrier to mite-induced allergen particles.

14. The method according to claim 13, wherein the article is a mattress or pillow.

15. The method according to claim 13, wherein the fabric is used as a pillow ticking, mattress ticking, mattress cover, mattress pad, bedspread or duvet cover.

16. The method according to claim 13, wherein the fabric has a maximum pore size of 10 microns.

17. The method according to claim 13, wherein the fabric further includes an antimicrobial finish to provide protection against mold and mildew.

18. The method according to claim 13, wherein the fabric further includes a fluorochemical finish to provide protection against fluid stains.

* * * * *

UNITED STATES PATENT AND TRADEMARK OFFICE

CERTIFICATE OF CORRECTION

PATENT NO. : 7,290,381 B2
APPLICATION NO. : 10/840662
DATED : November 6, 2007
INVENTOR(S) : John Martin Smith, III and Charles Woody Duckett It is certified that error appears in the above-identified patent and that said Letters Patent is hereby corrected as shown below:

Column 6,
Lines 15-16, "Dow Coming" should be replaced by --Dow Corning--.

Column 8,
Line 55, "2.8 grams" should be replaced by --21.8 grams--.

Signed and Sealed this

Fifteenth Day of July, 2008

JON W. DUDAS
*Director of the United States Patent and Trademark Office*

UNITED STATES PATENT AND TRADEMARK OFFICE

CERTIFICATE OF CORRECTION

PATENT NO. : 7,290,381 B2
APPLICATION NO. : 10/840662
DATED : November 6, 2007
INVENTOR(S) : John Martin Smith, III and Charles Woody Duckett It is certified that error appears in the above-identified patent and that said Letters Patent is hereby corrected as shown below:

In the Specification

Column 6,
Lines 15-16, "Dow Coming" should be replaced by --Dow Corning--.

Column 8,
Line 55, "21.8 grams" should be replaced by --2.8 grams--.

This certificate supersedes the Certificate of Correction issued July 15, 2008.

Signed and Sealed this
Fourteenth Day of July, 2015

Michelle K. Lee

Michelle K. Lee
*Director of the United States Patent and Trademark Office*